US008503913B2

(12) United States Patent
Sasaki

(10) Patent No.: US 8,503,913 B2
(45) Date of Patent: Aug. 6, 2013

(54) TONER DISPERSING MECHANISM, AND DEVELOPING DEVICE AND IMAGE FORMING APPARATUS PROVIDED THEREWITH

(75) Inventor: Asami Sasaki, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 195 days.

(21) Appl. No.: 13/032,949

(22) Filed: Feb. 23, 2011

(65) Prior Publication Data

US 2011/0229210 A1 Sep. 22, 2011

(30) Foreign Application Priority Data

Mar. 17, 2010 (JP) ..... 2010-060526

(51) Int. Cl.
*G03G 15/08* (2006.01)

(52) U.S. Cl.
USPC ..... 399/255

(58) Field of Classification Search
USPC ..... 399/119, 258, 260, 254–256
See application file for complete search history.

(56) References Cited

U.S. PATENT DOCUMENTS

| | | | | |
|---|---|---|---|---|
| 4,743,658 | A | 5/1988 | Imbalzano et al. | |
| 5,629,758 | A | 5/1997 | Kageyama et al. | |
| 5,708,939 | A * | 1/1998 | Oikawa et al. | 399/252 |
| 7,593,672 | B2 * | 9/2009 | Woo | 399/258 |
| 7,835,674 | B2 * | 11/2010 | Woo | 399/258 |
| 8,229,328 | B2 * | 7/2012 | Yamamoto | 399/258 |
| 2002/0127031 | A1 | 9/2002 | Arai et al. | |
| 2004/0179865 | A1 | 9/2004 | Nishiyama | |
| 2012/0183334 | A1 * | 7/2012 | Sasaki et al. | 399/258 |

FOREIGN PATENT DOCUMENTS

| | | | |
|---|---|---|---|
| JP | 2-111161 | | 9/1990 |
| JP | 8-30097 | | 2/1996 |
| JP | 10-69155 | | 3/1998 |
| JP | 2000-275939 | | 10/2000 |
| JP | 2001290350 | A * | 10/2001 |
| JP | 2003-287958 | | 10/2003 |
| JP | 2004-272017 | | 9/2004 |
| JP | 2006-251512 | | 9/2006 |
| JP | 2007-147893 | | 6/2007 |
| JP | 2007-241007 | | 9/2007 |
| JP | 2008-83287 | | 4/2008 |
| JP | 2008-268783 | | 11/2008 |
| JP | 2008-304650 | | 12/2008 |

* cited by examiner

*Primary Examiner* — Robert Beatty
(74) *Attorney, Agent, or Firm* — Smith, Gambrell & Russell, LLP

(57) ABSTRACT

Provided is a toner dispersing mechanism, including: a housing arranged between a toner storage container and a developing device and provided with a toner filling port communicating to the toner storage container and a toner discharge port communicating to the developing device; and a dispersing member constituted by a large number of dispersing protrusions formed of an elastic material on a rotary shaft rotatably supported in the housing and on an outer peripheral surface of the rotary shaft, in which toner replenished from the toner storage container is dispersed and discharged into the developing device.

20 Claims, 8 Drawing Sheets

TONER DISPERSING MECHANISM, AND DEVELOPING DEVICE AND IMAGE FORMING APPARATUS PROVIDED THEREWITH

This application is based upon and claims the benefit of priority from the corresponding Japanese Patent Application No. 2010-60526 filed on Mar. 17, 2010, the entire contents of which are incorporated herein by reference.

BACKGROUND OF THE INVENTION

1. Field of the Invention

The present invention relates to a toner dispersing mechanism, and a developing device and an image forming apparatus provided therewith, the toner dispersing mechanism being mounted to an electrophotographic image forming apparatus such as a copier, a printer, and a facsimile, and dispersing toner replenished from a toner storage container such as a hopper and a container into a developing device.

2. Description of Related Art

Conventionally, for facilitation of the maintenance, a predetermined amount of toner is filled in advance into the developing device mounted to the image forming apparatus, and the developing device itself is replaced when the toner is depleted. However, the developing device cannot be frequently replaced from an economic viewpoint, and a toner capacity of the developing device is inevitably increased for performing image formation on many sheets to some extent. Thus, the above-mentioned developing device is difficult to downsize. Under the circumstance, in order to achieve downsizing of the developing device, there has been proposed a developing device of a type to which toner is supplied from outside.

In the developing device of the toner supply type, a lump of toner is sometimes replenished into the developing device when toner fluidity is reduced owing to use environments and the like. Thus, there is a risk that the mixing property of the lump of toner and developer existing in the developing device are deteriorated and a developer thin layer formed on a developing roller is disturbed, with the result that image failures such as an image density unevenness and fogging occur.

Under the circumstance, there have been proposed various technologies for suppressing occurrence of the image failures by preceding dispersion of the toner replenished into the developing device. For example, as disclosed in the first related art, there has been known a developing device in which a matrix member (mesh) and a brush-like developer supply roller are arranged between a developer carrier and a developer storage portion. Further, as disclosed in the second related art, there has been known a developing device provided with a toner-replenishing-port stirring member for stirring toner in a toner replenishing port of a toner hopper. Still further, as disclosed in the third related art, there has been known a method in which a toner dispersing member constituted by a core and a cylindrical foam member is arranged so as to close a replenishing port of a toner bottle, and toner is dropped little by little into a developing device by rotation of the toner dispersing member.

Meanwhile, as disclosed in the fourth related art, there has been known an image forming apparatus which includes an auxiliary stirring container for separately receiving toner replenished from a toner replenishing container and carrier replenished from a carrier replenishing container and sufficiently mix and stir the toner and the carrier with use of a stirring/conveying member having a screw-like shape, and in which developer preliminarily mixed in the auxiliary stirring container and having a stable charging property is supplied to the developing device.

SUMMARY OF THE INVENTION

An object of the present invention is to provide a toner dispersing mechanism for causing toner replenished from a toner storage container to enter a dispersed state with a simple structure and supplying the toner into a developing device, and a developing device provided therewith. Further, another object of the present invention is to provide an image forming apparatus in which image failures such as density unevenness and fogging can be effectively suppressed with the toner dispersing mechanism and the developing device.

The toner dispersing mechanism according to one aspect of the present invention is a toner dispersing mechanism arranged between the toner storage container and the developing device and dispersing toner replenished from the toner storage container, the toner dispersing mechanism including a housing provided with a toner filling port communicating to the toner storage container and a toner discharge port communicating to the developing device, and a dispersing member consists of a rotary shaft rotatably supported in the housing and a large number of dispersing protrusions formed of an elastic material on an outer peripheral surface of the rotary shaft.

Further features and advantages of the present invention will become apparent from the description of embodiments given below.

DETAILED DESCRIPTION OF PREFERRED EMBODIMENTS

Figure 1:
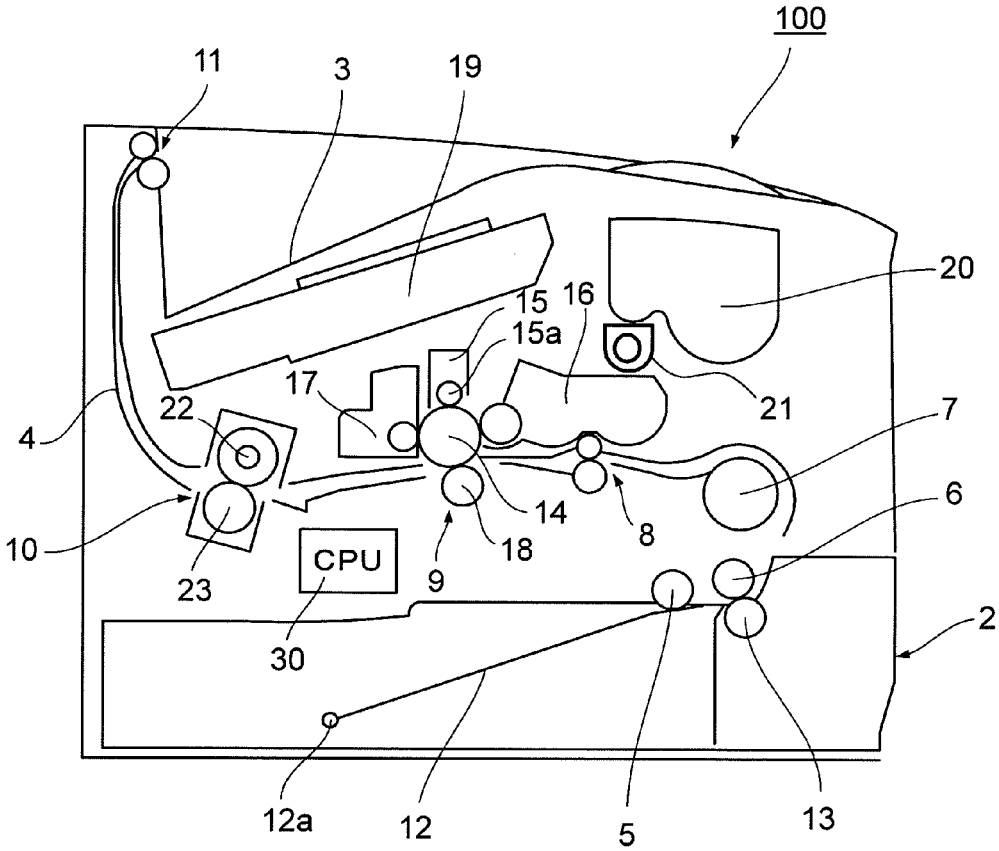
FIG. 1 is a schematic structural view of an entire structure of an image forming apparatus of the present invention.

In the following, description is made of embodiments of the present invention with reference to the figures. FIG. 1 is a schematic structural view of an entire structure of an image forming apparatus to which a toner dispersing mechanism according to the embodiments of the present invention and a developing device provided therewith is mounted, in which a right side is illustrated as a front side of the image forming apparatus. As illustrated in FIG. 1, an image forming apparatus 100 is provided with a sheet feeding cassette 2 for storing sheets stacked in a lower portion of a main unit of the image forming apparatus 100. Above the sheet feeding cassette 2, there is formed a sheet conveyance path 4 extending in a substantially horizontal manner from the front to the rear of the main unit of the image forming apparatus 100, and further extending upward to a sheet delivery portion 3 formed on an upper surface of the main unit of the image forming apparatus 100. Along the sheet conveyance path 4, a pick-up roller 5, a feed roller 6, an intermediate conveyance roller 7, a registration roller pair 8, an image forming portion 9, a fixing portion 10, and a delivery roller pair 11 are arranged in the stated order from the upstream side. Further, in the image forming apparatus 100, there is arranged a control portion (CPU) 30 for controlling operations of each of the rollers described above, the image forming portion 9, the fixing portion 10, and the like.

The sheet feeding cassette 2 is provided with a sheet stacking plate 12 rotationally supported with respect to the sheet feeding cassette 2 by a rotation fulcrum 12*a* provided at a rear end portion in a sheet conveying direction. The sheets stacked on the sheet stacking plate 12 are pressed by the pick-up roller 5. Further, on a front side of the sheet feeding cassette 2, a retard roller 13 is arranged in press contact with the feed roller 6. When a plurality of sheets are simultaneously fed by the pick-up roller 5, the sheets are fanned by the feed roller 6 and the retard roller 13 so that only an uppermost one of the sheets is conveyed.

Then, the sheet fanned by the feed roller 6 and the retard roller 13 is changed in conveying direction by the intermediate conveyance roller 7 to the rear of the apparatus, conveyed to the registration roller pair 8, and fed to the image forming portion 9 after being timed by the registration roller pair 8.

The image forming portion 9 is provided to form a predetermined toner image onto a sheet by an electrophotographic process, and includes a photosensitive drum 14 as an image carrier rotatably and axially supported in a clockwise direction in FIG. 1, a charging device 15, a developing device 16, a cleaning device 17 which are arranged around the photosensitive drum 14, a transfer roller 18 arranged so as to face the photosensitive drum 14 across the sheet conveyance path 4, and an exposing unit (LSU) 19 arranged above the photosensitive drum 14. A toner container 20 for replenishing toner to the developing device 16 is arranged above the developing device 16. A toner dispersing mechanism 21 for dispersing the toner replenished to the developing device 16 is arranged between the developing device 16 and the toner container 20.

The charging device 15 is provided with a conductive rubber roller 15*a* to which a power source (not shown) is connected, the conductive rubber roller 15*a* being arranged in contact with the photosensitive drum 14. When the photosensitive drum 14 is rotated, the conductive rubber roller 15*a* comes into contact with a surface of the photosensitive drum 14 and is rotated in accordance therewith. At this time, by application of a predetermined voltage to the conductive rubber roller 15*a*, the surface of the photosensitive drum 14 is uniformly charged.

Next, an electrostatic latent image based on input image data is formed on the photosensitive drum 14 by a laser beam from the exposing unit (LSU) 19. Then, toner is adhered to the electrostatic latent image by the developing device 16, and a toner image is formed on the surface of the photosensitive drum 14. The toner image on the surface of the photosensitive drum 14 is transferred by the transfer roller 18 to the sheet fed to a transfer position formed at a nip portion between the photosensitive drum 14 and the transfer roller 18.

The sheet having the toner image transferred thereon is separated from the photosensitive drum 14 and conveyed to the fixing portion 10. The fixing portion 10 is arranged on the downstream side of the sheet conveying direction of the image forming portion 9. The sheet having the toner image transferred thereon at the image forming portion 9 is heated and pressed respectively by a heating roller 22 provided to the fixing portion 10 and a pressure roller 23 to be brought into press contact with the heating roller 22, and the toner image transferred onto the sheet is fixed.

The sheet subjected to the image formation at the image forming portion 9 and the fixing portion 10 is delivered onto the sheet delivery portion 3 by the delivery roller pair 11. Meanwhile, residual toner on the surface of the photosensitive drum 14 after the transfer is removed by the cleaning device 17. Then, the photosensitive drum 14 is recharged by the charging device 15, and image formation is sequentially performed as described above.

Figure 2:
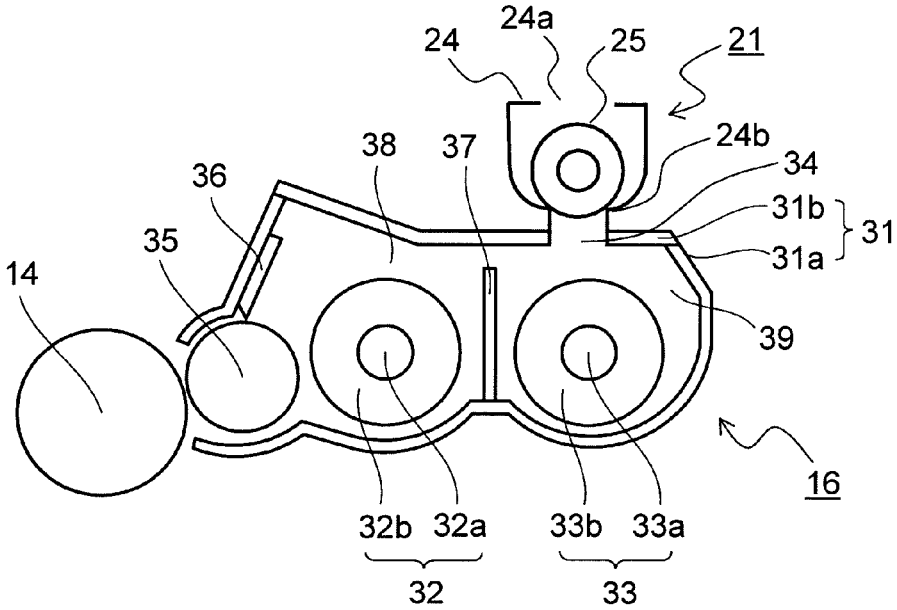
FIG. 2 is a side sectional view of a developing device including a toner dispersing mechanism according to a first embodiment of the present invention (sectional view taken along arrows X-X' of FIG. 3)
Figure 3:
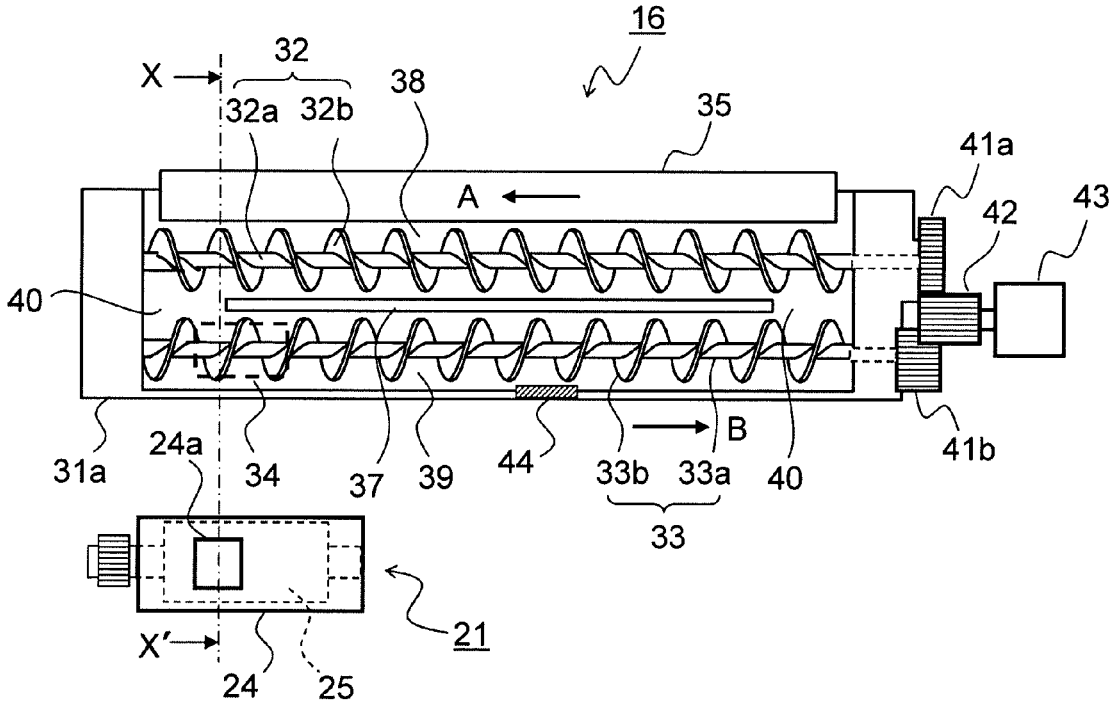
FIG. 3 is a plan view viewed from above of the developing device including the toner dispersing mechanism according to the first embodiment of the present invention.

Next, with reference to FIGS. 2 and 3, detailed description is made of the developing device 16 provided with the toner dispersing mechanism of the present invention. FIG. 2 is a side sectional view of the developing device of the present invention, and FIG. 3 is a plan view viewed from above of the developing device. Note that, FIG. 2 corresponds to a sectional view taken along the arrows X-X' of FIG. 3, and FIG. 3 illustrates a state in which a cover 31*b* is removed for the sake of convenience in illustration.

As illustrated in FIGS. 2 and 3, the developing device 16 includes a developing container 31 constituted by a container main unit 31*a* for storing a two-component developer including a non-magnetic toner and a magnetic carrier and the cover 31*b* for sealing to prevent the developer stored in the container main unit 31*a* from leaking outside. In the developing container 31, there are provided a first stirring/conveying screw 32, a second stirring/conveying screw 33, a developing roller 35, and a regulating blade 36.

An inside of the container main unit 31*a* is portioned by a partition plate 37 extending in a long side direction into a first storage chamber 38 and a second storage chamber 39. The first stirring/conveying screw 32 is arranged in the first storage chamber 38, and the second stirring/conveying screw 33 is arranged in the second storage chamber 39. Further, as illustrated in FIG. 3, the partition plate 37 is not provided up to both right and left end portions of the container main unit 31*a*, and those end portions constitute paths (developer exchange portions) 40 through which the developer moves between the first storage chamber 38 and the second storage chamber 39.

The first stirring/conveying screw 32 and the second stirring/conveying screw 33 are respectively constituted by rotary shafts 32*a* and 33*a* and helical blades 32*b* and 33*b* formed integrally with outer peripheral surfaces thereof, and rotatably and axially supported in the container main unit 31*a* so as to be substantially parallel with each other. The first stirring/conveying screw 32 and the second stirring/conveying screw 33 are rotated in predetermined directions so as to convey the developer in the first storage chamber 38 in a direction of an arrow A and convey the developer in the second storage chamber 39 in a direction of an arrow B. Further, in order that toner can be replenished into the container main unit 31*a* in accordance with detection results of a toner concentration sensor 44 described later, the cover 31*b* is provided with a toner replenishing port 34 through which toner is supplied from the toner container 20 (refer to FIG. 1).

Further, drive input gears 41*a* and 41*b* are coupled to the rotary shafts 32*a* and 33*a* of the first stirring/conveying screw 32 and the second stirring/conveying screw 33, and a motor 43 is connected to the drive input gears 41*a* and 41*b* through intermediation of a drive output gear 42. The drive input gears 41*a* and 41*b*, the drive output gear 42, and the motor 43 drive-rotate the first stirring/conveying screw 32 and the second stirring/conveying screw 33 in the predetermined directions. With this, the developer is conveyed in the first storage chamber 38 and the second storage chamber 39, and as described above, circulates in the first storage chamber 38 and the second storage chamber 39 through the paths 40 provided to both the right and left end portions of the container main unit 31*a*.

The developing roller 35 is rotatably and axially supported in the first storage chamber 38 so as to be substantially parallel with the first stirring/conveying screw 32 and the second stirring/conveying screw 33, and the motor 43 is connected to the developing roller 35 through intermediation of a gear train (not shown). A magnet roller having an inner surface to which a magnetic-field generating member (not shown) constituted by a permanent magnet is fixed is used as the developing roller 35. When the developing roller 35 is rotated in accordance with rotation of the photosensitive drum 14, a magnetic force of the magnetic-field generating member causes the developer to adhere to (be carried by) a surface of the developing roller 35, with the result that a developer layer is formed.

Then, toner in the developer adhering to the developing roller 35 in a predetermined developing region adheres to a photosensitive layer by being caused to fly to the photosensitive drum 14 due to potential difference between a surface potential of the photosensitive drum 14 and a developing bias applied to the developing roller 35. In this manner, a toner image is formed on the surface of the photosensitive drum 14. Note that, a drive means other than the motor 43 may be connected to the developing roller 35 so as to independently drive the developing roller 35.

The regulating blade 36 is provided to regulate an amount of toner supplied to the photosensitive drum 14, that is, a developer adhesion amount with respect to the developing roller 35. For example, the regulating blade 36 is made of a non-magnetic stainless (SUS) such as SUS303, and is arranged so that a predetermined gap is formed between a distal end of the regulating blade 36 and the developing roller 35. The gap between the regulating blade 36 and the developing roller 35 regulates the developer adhesion amount with respect to the developing roller 35, and a thin developer layer having a thickness of several hundred microns is formed on the surface of the developing roller 35.

The toner concentration sensor 44 is arranged on an inner wall surface of the second storage chamber 39. As the toner concentration sensor 44, there is used a magnetic permeability sensor for detecting a magnetic permeability of the two-component developer constituted by toner and a magnetic carrier in the container main unit 31*a*. Here, a toner density represents a ratio of the toner to the magnetic carrier in the developer. In this embodiment, the toner concentration sensor 44 detects the magnetic permeability of the developer and outputs a voltage value corresponding to a detection result thereof to the control portion 30 (refer to FIG. 1). The control portion 30 determines the toner density based on an output value from the toner concentration sensor 44.

The sensor output value varies in accordance with the toner density. Specifically, the ratio of the toner to the magnetic carrier becomes higher in proportion to the toner density, and the output value decreases due to an increase in percentage of the non-magnetic toner. Meanwhile, the ratio of the toner to the carrier becomes lower in reverse proportion to the toner density, and the output value increases due to an increase in percentage of the magnetic carrier.

The toner dispersing mechanism 21 is constituted by a housing 24 formed integrally with the cover 31*b* of the developing device 16, and a dispersing member 25 rotatably supported in the housing 24. A toner filling port 24*a* is formed in an upper surface of the housing 24, and a toner discharge port 24*b* communicating to the toner replenishing port 34 of the developing device 16 is formed in a lower surface of the housing 24. When a predetermined amount of toner is injected from the toner filling port 24*a* into the toner dispersing mechanism 21 in accordance with an output of the toner concentration sensor 44, a lump of the toner is dispersed by rotation of the dispersing member 25 and then discharged from the toner discharge port 24*b*, with the result of being replenished into the developing device 16 through the toner replenishing port 34.

Note that, the term "dispersion" as used herein represents a state in which the toner is powdered into particles, which is clearly distinguished from "mixture" effected by screws and helixes.

Figure 4:
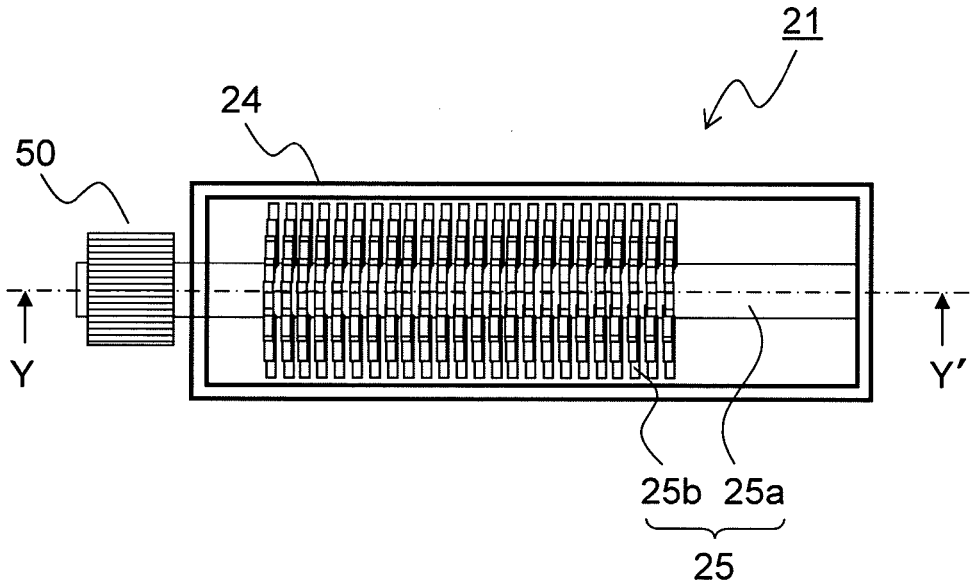
FIG. 4 is a plan view of the toner dispersing mechanism according to the first embodiment of the present invention.
Figure 5:
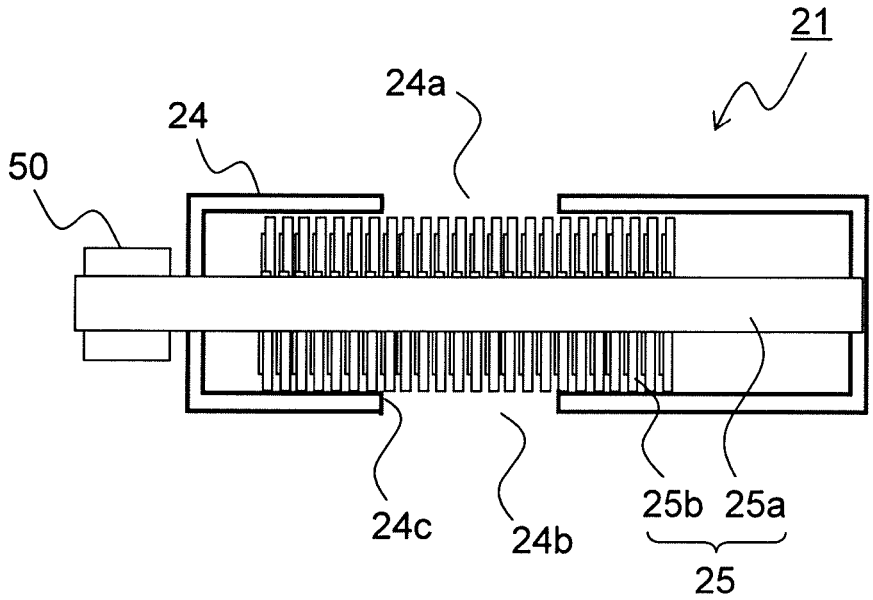
FIG. 5 is a side sectional view of the toner dispersing mechanism according to the first embodiment of the present invention (sectional view taken along the arrows Y-Y' of FIG. 4)

FIG. 4 is a plan view of the toner dispersing mechanism according to the first embodiment of the present invention, and FIG. 5 is a side sectional view of the toner dispersing mechanism according to the first embodiment (sectional view taken along the arrows Y-Y' of FIG. 4). Note that, for the sake of convenience in illustration, FIG. 4 illustrates a state in which an inside of the housing 24 is visible with the upper surface thereof being open. As illustrated in FIGS. 4 and 5, the dispersing member 25 includes a large number of dispersing protrusions 25*b* formed of an elastic material on an outer peripheral surface of a rotary shaft 25*a*. One end of the rotary shaft 25*a* extends to an outside of the housing 24, and a drive input gear 50 is fixed thereto. The drive input gear 50 is coupled to a dispersing-member drive motor (not shown) through intermediation of a gear train (not shown).

By rotation of the dispersing member 25 timed to injection of toner from the toner container 20 (refer to FIG. 1) into the toner filling port 24*a*, distal ends of the dispersing protrusions 25*b* rock by being brought into contact with an inner surface of the housing 24 and an opening rim 24*c* of the toner discharge port 24*b*. As a result, a lump of toner entered from the toner filling port 24*a* into the housing 24 can be efficiently dispersed to particles. Examples of elastic materials forming the dispersing protrusions 25*b* include a flexible resin material such as a thermoplastic elastomer and rubber, a PET film, a sponge, and a fur brush.

Figure 6:
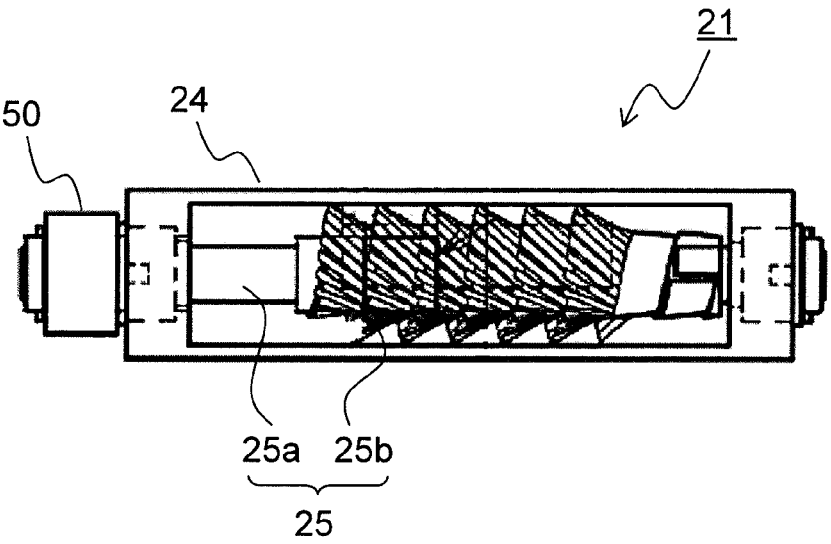
FIG. 6 is a plan view of a toner dispersing mechanism according to a second embodiment of the present invention.

FIG. 6 is a plan view of a toner dispersing mechanism according to a second embodiment of the present invention. Note that, for the sake of convenience in illustration, FIG. 6 illustrates a state in which the inside of the housing 24 is visible with the upper surface thereof being open as in FIG. 4. The dispersing member 25 in this embodiment includes dispersing protrusions 25*b* formed of a PET film fixed to an outer peripheral surface of the rotary shaft 25*a* by being helically wound thereabout and provided with a large number of slits. By the rotation of the dispersing member 25, the lump of toner entered from the toner filling port 24*a* can be efficiently dispersed to particles as in the first embodiment.

Figure 7A:
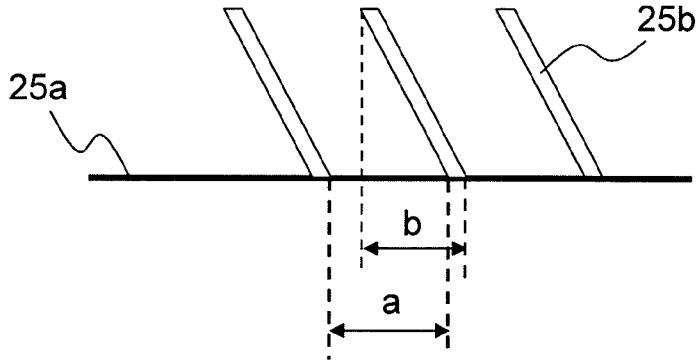
FIG. 7 are partially enlarged views each illustrating a relation between a pitch a between dispersing protrusions in a direction of a rotary shaft of the toner dispersing mechanism and a projection length b of one of the dispersing protrusions with respect to the rotary shaft according to the second embodiment of the present invention.

FIG. 7 are enlarged sectional views of the dispersing member 25 used for the toner dispersing mechanism according to the second embodiment. As illustrated in FIG. 7A, when a relation a≧b is established where "a" represents an interval (pitch) of the dispersing protrusions 25*b* in a thrust direction of the rotary shaft 25*a* and "b" represents a projection length of one of the dispersing protrusions 25*b* with respect to the rotary shaft 25*a* viewed from a perpendicular direction, there is a risk that the lump of toner injected from the toner filling port 24*a* passes through gaps among the dispersing protrusions 25*b* and is replenished from the toner discharge port 24*b* into the developing device 16 without being sufficiently dispersed.

Figure 7B:
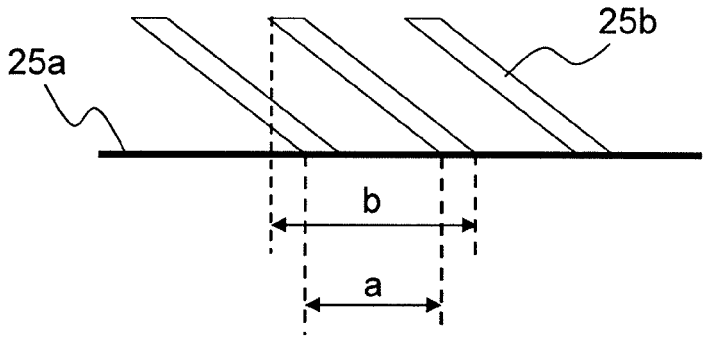

In contrast, as illustrated in FIG. 7B, when a relation a<b is established, the lump of toner injected from the toner filling port 24*a* comes into contact with the dispersing protrusions 25*b* without fail, and is finely dispersed while being conveyed in the long side direction. Accordingly, it is preferred that the dispersing protrusions 25*b* be fixed to the rotary shaft 25*a* while being inclined with respect thereto by a predetermined amount so that the relation a<b is established.

Figure 8:
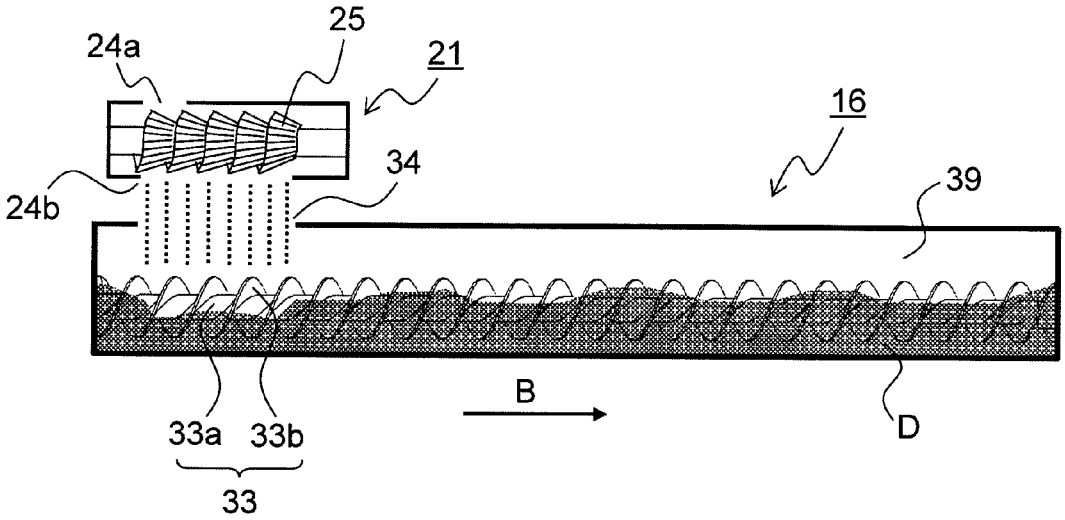
FIG. 8 is a side sectional view illustrating a positional relation between the toner dispersing mechanism according to the second embodiment of the present invention and the developing device.

FIG. 8 is a side sectional view illustrating a positional relation between the toner dispersing mechanism according to the second embodiment and the developing device. In this embodiment, the toner discharge port 24*b* in the long side direction of the dispersing member 25 (lateral direction of FIG. 8) is formed to have an opening width larger than an opening width of the toner filling port 24*a*. By rotation of the helically-arranged dispersing protrusions 25*b*, the toner injected from the toner filling port 24*a* into the housing 24 is dispersed and conveyed in the long side direction, with the result of being supplied from substantially the entire region of the toner discharge port 24*b* into the second storage chamber 39 of the developing device 16 through the toner replenishing port 34.

With this structure, the toner is replenished over a wide range in the second storage chamber 39, and hence can be quickly mixed with a developer D existing in the second storage chamber 39 by the second stirring/conveying screw 33. The opening width of the toner discharge port 24*b* can be appropriately set in accordance with toner properties to be used and specifications of the developing device 16 and the like.

Further, as illustrated in FIG. 8, the developer D is small in height immediately below the toner discharge port 24*b* (toner dropping position) in comparison with other parts, and an upper surface of a rotary shaft 33*a* of the second stirring/conveying screw 33 is exposed. With this, the toner discharged from the toner discharge port 24*b* is replenished to a vicinity of the rotary shaft 33*a* of the second stirring/conveying screw 33 through the toner replenishing port 34, and conveyed in the direction of the arrow B while being caused to alternately ascend and descend by a helical blade 33*b*. Accordingly, newly replenished toner can be efficiently stirred together with the developer D.

In order to reduce the height of the developer D immediately below the toner discharge port 24*b*, it is only necessary that a conveying speed of the developer in the second storage chamber 39 be partially changed by variation of the pitch of the helical blade 33*b* or provision of ribs to the rotary shaft 33*a*.

Figure 9:
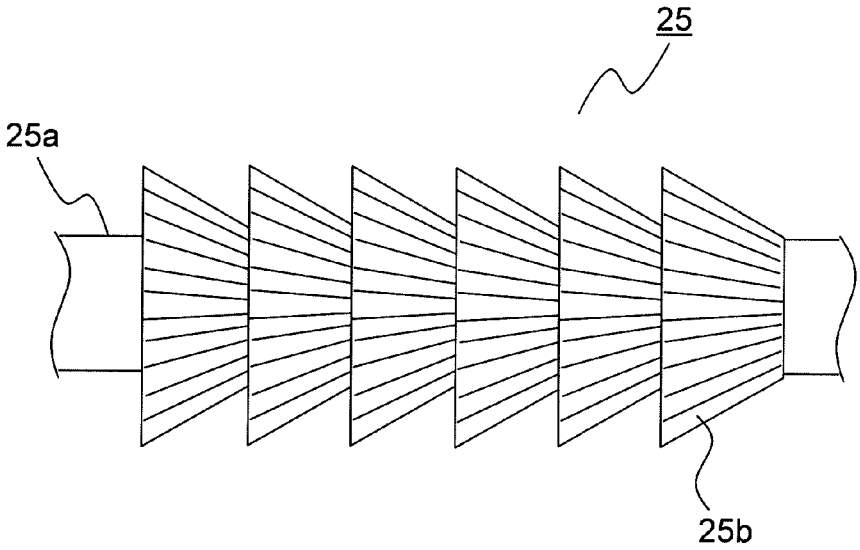
FIG. 9 is a side view of another structural example of a dispersing member used for the toner dispersing mechanism according to the second embodiment of the present invention.

FIG. 9 is a side view illustrating a modification of the dispersing member 25 used for the toner dispersing mechanism according to the second embodiment. In FIG. 9, dispersing protrusions 25*b* are formed of a plurality of (six in this case) PET films provided with a large number of slits and conically wound about the rotary shaft 25*a* at a predetermined pitch. Also in this case, by fixation of the dispersing protrusions 25*b* so that the pitch a and the projection length b of the dispersing protrusions 25*b* satisfy the relation a<b as illustrated in FIG. 7B, the lump of toner can be efficiently dispersed by rocking of the dispersing protrusions 25*b* as in the structure illustrated in FIG. 6. Note that, in the dispersing member 25 illustrated in FIG. 9, a toner conveying force of the dispersing member 25 in the long side direction is smaller than that in the case where the dispersing protrusions 25*b* are helically arranged. Thus, when the opening width of the toner discharge port 24*b* is increased as illustrated in FIG. 8, it is more preferred that the dispersing protrusions 25*b* be helically arranged as in FIG. 6.

Figure 10:
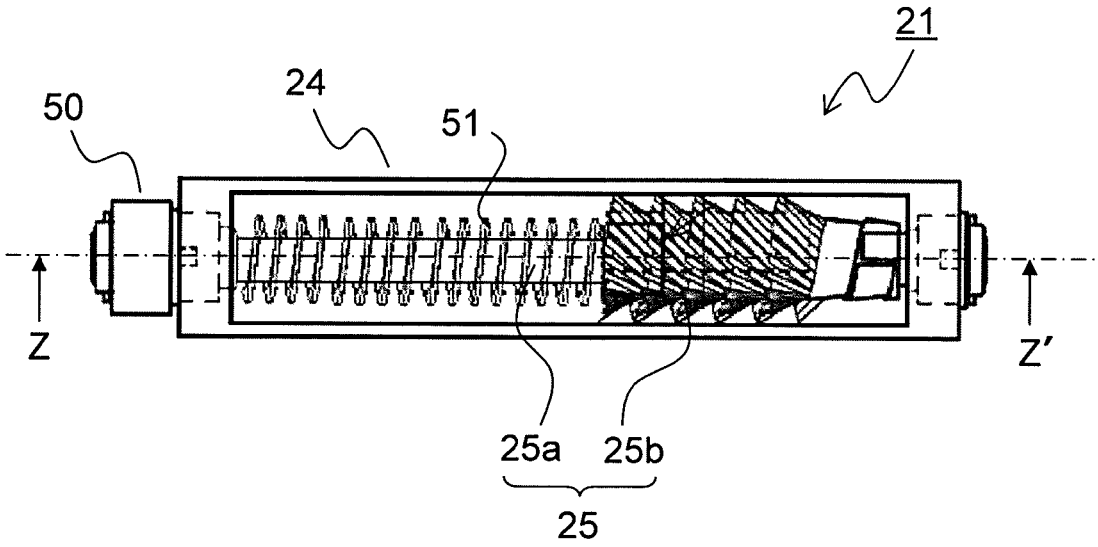
FIG. 10 is a plan view of a toner dispersing mechanism according to a third embodiment of the present invention.
Figure 11:
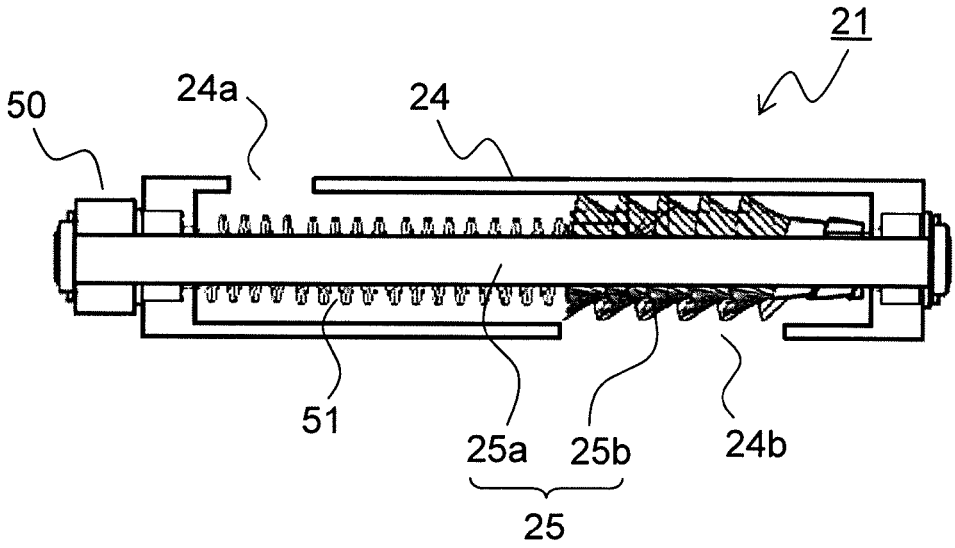
FIG. 11 is a side sectional view according to the third embodiment of the present invention.

FIG. 10 is a plan view of the toner dispersing mechanism according to the third embodiment of the present invention, and FIG. 11 is a side sectional view of the toner dispersing mechanism according to the third embodiment (sectional view taken along the arrows Z-Z' of FIG. 10). In this embodiment, by provision of a helical conveying blade to a part without the dispersing protrusions 25*b* of the outer peripheral surface of the rotary shaft 25*a* constituting the dispersing member 25, the rotary shaft 25*a* partially serves as a screw portion 51. Further, the toner filling port 24*a* is formed above the screw portion 51, and the toner discharge port 24*b* is formed below the dispersing protrusions 25*b*. Other structural details are the same as those in the second embodiment, and hence description thereof is omitted.

With this structure, the toner injected from the toner filling port 24*a* into the housing 24 is conveyed to the dispersing protrusions 25*b* by rotation of the screw portion 51. After being dispersed to particles by the dispersing protrusions 25*b*, the toner is supplied from the toner discharge port 24*b* into the toner replenishing port 34 (refer to FIG. 8). Accordingly, the lump of toner can be efficiently dispersed even when the toner discharge port 24*b* cannot be formed immediately below the toner filling port 24*a* owing to limitation of layout of the apparatus.

Figure 12:
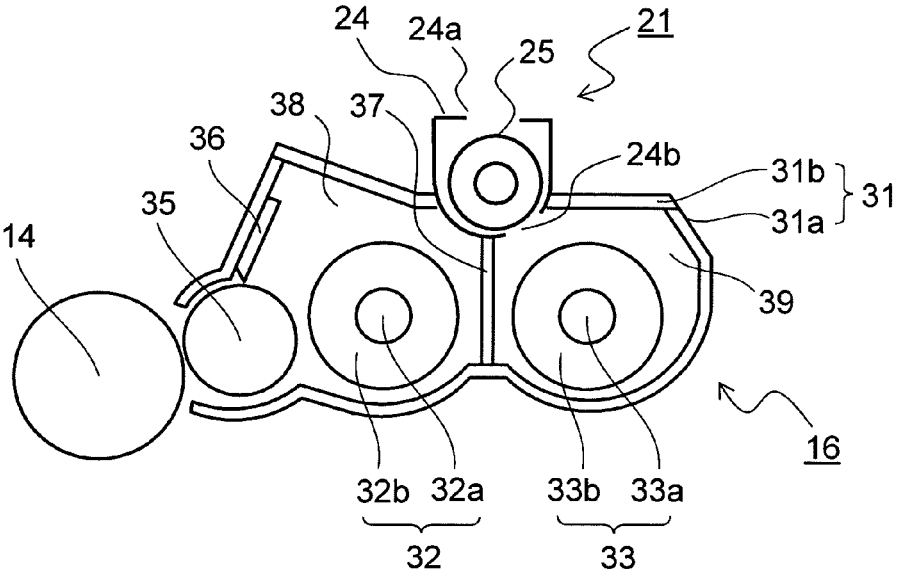
FIG. 12 is a side sectional view illustrating an example that the toner dispersing mechanism according to the embodiments of the present invention is arranged on a border between a first storage chamber and a second storage chamber of the developing device.

Note that, although description is made of the case where, according to each of the above-mentioned embodiments, the toner discharge port 24*b* is provided in the lower surface of the housing 24 in the toner dispersing mechanism 21 and the toner dispersing mechanism 21 is arranged immediately above the second storage chamber 39 of the developing device 16, this should not be construed restrictively. For example, as illustrated in FIG. 12, the toner dispersing mechanism 21 may be arranged on a boundary between the first storage chamber 38 and the second storage chamber 39, and the toner discharge port 24*b* communicating to the second storage chamber 39 may be formed in a side surface of the housing 24. With this structure, an arrangement space for the toner dispersing mechanism 21 can be reduced.

Figure 13:
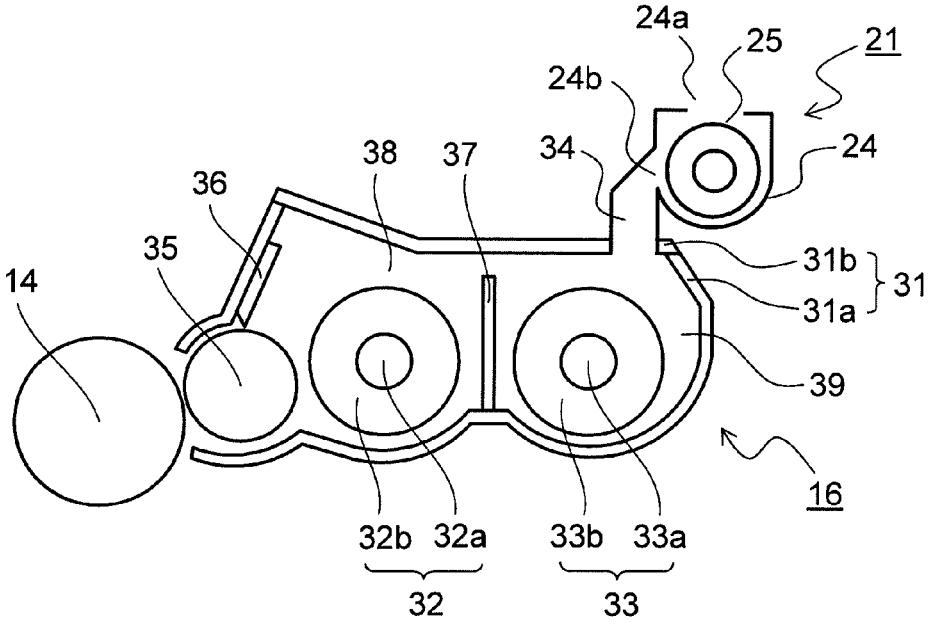
FIG. 13 is a side sectional view illustrating an example that the toner dispersing mechanism according to the embodiments of the present invention is arranged diagonally above the developing device.

Further, owing to limitation of layout of the image forming apparatus, the toner dispersing mechanism 21 may not be arranged immediately above the developing device 16 in some cases. In such a case, for example, as illustrated in FIG. 13, the toner discharge port 24*b* is formed in the side surface of the housing 24 of the toner dispersing mechanism 21, and the toner replenishing port 34 for communicating the toner discharge port 24*b* and the second storage chamber 39 with each other is formed in a bent shape. With this, toner dropping positions can be controlled.

The present invention is not limited to the above-mentioned embodiments, and various modifications may be made thereto within the spirit of the present invention. For example, the present invention is not limited to the developing device 16 as illustrated in FIGS. 2 and 3, and applicable to, for example, a developing device including a stirring paddle provided between the first stirring/conveying screw 32 and the developing roller 35, or a touch-down developing device including a supply roller (magnetic roller) provided between the first stirring/conveying screw 32 and the developing roller 35. Further, the present invention is not limited to a structure in which two stirring/conveying members 32 and 33 are provided, and applicable, for example, to a developing device including one stirring/conveying member.

Note that, in each of the above-mentioned embodiments, the developing device is exemplified, in which the two-component developer including a magnetic carrier and toner is used, however, the present invention is applicable also to a developing device in which a one-component developer constituted only by toner is used. Further, the image forming apparatus of the present invention is not limited to a monochrome printer as illustrated in FIG. 1, and may be another image forming apparatus such as a monochrome copier, a color copier, a color printer, and a facsimile. In the following examples, further description is made of advantages of the present invention.

Example 1

An examination of toner charging properties of the developing device of the present invention was carried out. The developing device 16 provided with the toner dispersing mechanism 21 according to the second embodiment as illustrated in FIG. 6 was prepared as a product of the present invention. Meanwhile, a developing device without the toner dispersing mechanism 21 was prepared as a product of Comparison Example.

Figure 14:
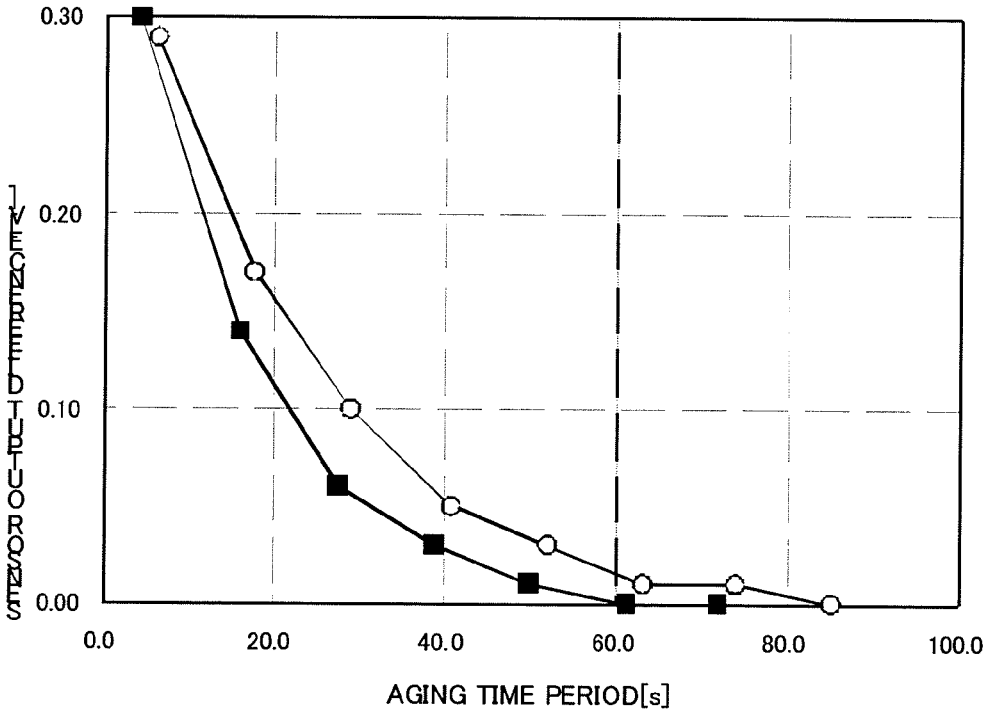
FIG. 14 is a graph showing a relation between an aging time period after toner replenishment and attenuation of a sensor output difference in a first example according to the embodiments of the present invention.

The following examination method was employed: 1.0 g of toner was injected into each of the developing devices of the present invention and Comparison Example, in each of which a two-component developer constituted by a magnetic carrier and toner is filled by a predetermined amount; an output value of the toner concentration sensor 44 after a predetermined aging time period had elapsed was measured; and an output difference (hereinafter, referred to as sensor output difference) between the measured output value and a sensor output value in a stable state was calculated. FIG. 14 shows the results of the examination.

FIG. 14 is a graph in which maximum values of the sensor output difference are plotted, the sensor output difference being obtained by the sensor output value attenuated while alternately increasing and decreasing (ripple) along with elapse of the aging time period from the stable state. As shown in FIG. 14, in the developing device provided with the toner dispersing mechanism according to the present invention, the sensor output difference was quickly attenuated (indicated by solid squares in the graph) and converged to 0 V in 60 seconds of the aging time period. In contrast, in the developing device of Comparison Example without the toner dispersing mechanism (indicated by blank circles in the graph), 80 seconds or more of the aging time period was required until the sensor output difference was converged to 0 V. Those results proved that toner was able to be sufficiently mixed within a short time period by provision of the toner dispersing mechanism of the present invention, and the aging time period of the developing device was able to be reduced.

Example 2

An examination of a relation between the opening width of the toner discharge port 24*b* (refer to FIG. 8) and the toner charging properties was carried out in the developing device same as that in Example 1. The following examination method was employed: the opening width of the toner discharge port 24*b* was changed in three steps of 1 cm, 2 cm, and 3 cm; 1.0 g of toner was injected from the toner replenishing port 34 into the developing container 31; driving of the developing device was started; the driving of the developing device was stopped when the injected toner had reached an end portion of the developing container 31 (760 mm apart from the toner replenishing port); the developer at the end portion thereof (sampling position) was collected; a charging amount distribution of 1,000 toner particles was measured; and an average value of a charging amount per one toner particle q/d (nC/m) and a percentage (%) of toner having the charging amount q/d of smaller than 0.2 nC/m were calculated. Table 1 shows the results of the examination.

TABLE 1

| Opening width | Toner replenishment amount (g) | Count (%) q/d < 0.2 | Average q/d (nC/m) | 3σ |
|---|---|---|---|---|
| Default | 0.0 | 4.2 | 0.428 | 0.22 |
| 1 cm | 1.0 | 8.1 | 0.400 | 0.20 |
| 2 cm | 1.0 | 6.1 | 0.413 | 0.21 |
| 3 cm | 1.0 | 3.7 | 0.427 | 0.19 |

As is apparent from Table 1, the average values of q/d was substantially constant regardless of the opening widths of the toner discharge port 24*b*. Meanwhile, the percentage of the toner having the charging amount q/d of smaller than 0.2 nC/m was smaller in inverse proportion to the size of the opening width of the toner discharge port 24*b*. Those results confirmed that, a toner replenishment amount per unit area was reduced in inverse proportion to the size of the opening width of the toner discharge port 24*b*, and hence the developer in the developing device and the replenished toner were able to be sufficiently mixed with each other, which was advantageous in charging stabilization of the toner.

The present invention is summarized as follows based on each of the above-mentioned embodiments: the toner dispersing mechanism according to one embodiment of the present invention is arranged between a toner storage container and a developing device and dispersing toner replenished from the toner storage container, the toner dispersing mechanism including a housing provided with a toner filling port communicating to the toner storage container and a toner discharge port communicating to the developing device, and a dispersing member consists of a rotary shaft rotatably supported in the housing and a large number of dispersing protrusions formed of an elastic material on an outer peripheral surface of the rotary shaft.

With this structure, the toner replenished from the toner storage container can be effectively dispersed by the dispersing member having the dispersing protrusions formed of an elastic material. Thus, a simple and inexpensive toner dispersing mechanism is provided, in which there is no risk of clogging.

Further, the image forming apparatus according to one embodiment of the present invention is an image forming apparatus to which the toner dispersing mechanism, the developing device, and the toner storage container are mounted, the toner dispersing mechanism being configured as described above, the developing device having an upper portion to which the toner dispersing mechanism is coupled, the toner storage container being detachably arranged above the toner dispersing mechanism, for storing toner which is replenished into the developing device through intermediation of the toner dispersing mechanism.

With this structure, an image forming apparatus is provided in which mixture properties of the toner replenished from the toner storage container and the developer existing in the developing device can be enhanced and in which image failures such as a density unevenness and fogging can be effectively suppressed.

The developing devices according to the embodiments of the present invention are applicable to an image forming apparatus in which toner is replenished from a toner storage container such as a hopper and a container into a developing device. With use of the present invention, an image forming apparatus can be provided in which toner can be replenished into the developing device under a state in which the toner supplied from the toner storage container is sufficiently dispersed, and in which image failures such as a density unevenness and fogging can be effectively suppressed.

What is claimed is:

1. A toner dispersing mechanism, comprising:

a housing arranged between a toner storage container and a developing device and provided with a toner filling port communicating with the toner storage container and a toner discharge port communicating with the developing device; and a dispersing member comprising a rotary shaft rotatably supported in the housing and a large number of dispersing protrusions formed of an elastic material on an outer peripheral surface of the rotary shaft, wherein toner replenished from the toner storage container is dispersed and discharged into the developing device, and the large number of dispersing protrusions have distal ends held in contact with an opening rim of the toner discharge port.

2. A developing device, comprising:

the toner dispersing mechanism according to claim 1; and a developing container having an upper portion to which the toner dispersing mechanism is coupled.

3. A developing device according to claim 2, further comprising, in the developing container, a stirring/conveying member comprising a stirring/conveying blade formed on an outer peripheral surface of a stirring/conveying rotary shaft provided at a toner dropping position to which toner discharged from the toner discharge port drops, for circulatorily conveying developer in the developing container, the developer existing also at the toner dropping position.

4. A developing device according to claim 3, wherein the developer existing at the toner dropping position is smaller in height in comparison with an upper surface of the stirring/conveying rotary shaft.

5. A developing device according to claim 2, wherein the toner dispersing mechanism and the developing container are formed integrally with each other.

6. An image forming apparatus, comprising:

the developing device according to claim 2; and a toner storage container detachably arranged above the toner dispersing mechanism, for storing toner replenished into the developing device through intermediation of the toner dispersing mechanism.

7. A toner dispersing mechanism, comprising:

a housing arranged between a toner storage container and a developing device and provided with a toner filling port communicating with the toner storage container and a toner discharge port communicating with the developing device; and a dispersing member comprising a rotary shaft rotatably supported in the housing and a large number of dispersing protrusions formed of an elastic material on an outer peripheral surface of the rotary shaft, wherein toner replenished from the toner storage container is dispersed and discharged into the developing device, the toner discharge port in an axial direction of the dispersing member is formed to have an opening width larger than an opening width of the toner filling port, and the dispersing member disperses the toner injected from the toner filling port into the housing and discharges the toner from substantially the entire region of the toner discharge port.

8. A toner dispersing mechanism according to claim 7, wherein the large number of dispersing protrusions are fixed while being inclined with respect to an axial direction of the rotary shaft, and each has a projection length with respect to the rotary shaft, the projection length being larger than a pitch between the large number of dispersing protrusions in a direction of the rotary shaft.

9. A toner dispersing mechanism according to claim 8, wherein the large number of dispersing protrusions are helically arranged with respect to the rotary shaft.

10. A developing device, comprising:

the toner dispersing mechanism according to claim 2; and a developing container having an upper portion to which the toner dispersing mechanism is coupled.

11. A developing device according to claim 10, further comprising, in the developing container, a stirring/conveying member comprising a stirring/conveying blade formed on an outer peripheral surface of a stirring/conveying rotary shaft provided at a toner dropping position to which toner discharged from the toner discharge port drops, for circulatorily conveying developer in the developing container, the developer existing also at the toner dropping position.

12. A developing device according to claim 11, wherein the developer existing at the toner dropping position is smaller in height in comparison with an upper surface of the stirring/conveying rotary shaft.

13. A developing device according to claim 10, wherein the toner dispersing mechanism and the developing container are formed integrally with each other.

14. An image forming apparatus, comprising:

the developing device according to claim 10; and a toner storage container detachably arranged above the toner dispersing mechanism, for storing toner replenished into the developing device through intermediation of the toner dispersing mechanism.

15. A toner dispersing mechanism, comprising:

a housing arranged between a toner storage container and a developing device and provided with a toner filling port communicating with the toner storage container and a toner discharge port communicating with the developing device; and a dispersing member comprising a rotary shaft rotatably supported in the housing and a large number of dispersing protrusions formed of an elastic material on an outer peripheral surface of the rotary shaft, wherein toner replenished from the toner storage container is dispersed and discharged into the developing device, the rotary shaft is provided with a screw portion which has a conveying force exerted from the toner filling port to the toner discharge port and which is formed adjacently to the large number of dispersing protrusions, and the toner filling port is formed immediately above the screw portion.

16. A developing device, comprising:

the toner dispersing mechanism according to claim 15; and a developing container having an upper portion to which the toner dispersing mechanism is coupled.

17. A developing device according to claim 16, further comprising, in the developing container, a stirring/conveying member comprising a stirring/conveying blade formed on an outer peripheral surface of a stirring/conveying rotary shaft provided at a toner dropping position to which toner discharged from the toner discharge port drops, for circulatorily conveying developer in the developing container, the developer existing also at the toner dropping position.

18. A developing device according to claim 17, wherein the developer existing at the toner dropping position is smaller in height in comparison with an upper surface of the stirring/conveying rotary shaft.

19. A developing device according to claim 16, wherein the toner dispersing mechanism and the developing container are formed integrally with each other.

20. An image forming apparatus, comprising:

the developing device according to claim 16; and a toner storage container detachably arranged above the toner dispersing mechanism, for storing toner replenished into the developing device through intermediation of the toner dispersing mechanism.

* * * * *